US007207402B2

(12) United States Patent
Björk

(10) Patent No.: US 7,207,402 B2
(45) Date of Patent: Apr. 24, 2007

(54) PERCUSSION DRILL BIT AND A REGRINDABLE CEMENTED CARBIDE BUTTON THEREFOR

(75) Inventor: Fredrik Björk, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 250 days.

(21) Appl. No.: 10/509,658

(22) PCT Filed: Mar. 26, 2003

(86) PCT No.: PCT/SE03/00494

§ 371 (c)(1),
(2), (4) Date: Feb. 23, 2005

(87) PCT Pub. No.: WO03/085231

PCT Pub. Date: Oct. 16, 2003

(65) Prior Publication Data

US 2005/0161264 A1 Jul. 28, 2005

(30) Foreign Application Priority Data

Apr. 4, 2002 (SE) ..... 0201034

(51) Int. Cl.
*E21B 10/36* (2006.01)

(52) U.S. Cl. ..... 175/418; 175/432

(58) Field of Classification Search ..... None
See application file for complete search history.

(56) References Cited

U.S. PATENT DOCUMENTS

| | | | | |
|---|---|---|---|---|
| 3,788,409 | A | 1/1974 | Curington | |
| 4,058,177 | A * | 11/1977 | Langford et al. | 175/374 |
| 4,296,825 | A | 10/1981 | Larsson | |
| 4,598,779 | A | 7/1986 | Liljekvist et al. | |
| 5,421,424 | A * | 6/1995 | Portwood et al. | 175/374 |
| 5,881,828 | A * | 3/1999 | Fischer et al. | 175/374 |
| 6,220,376 | B1 | 4/2001 | Lundell | |

* cited by examiner

*Primary Examiner*—Frank Tsay
(74) *Attorney, Agent, or Firm*—Drinker Biddle & Reath LLP

(57) ABSTRACT

A percussion drill bit for drilling a bore includes a drill body having a connecting section at a rear end thereof for connection to a percussive unit, and a plurality of cemented carbide buttons embedded in a front end of the drill body. Each button comprises a cemented carbide body having a rear mounting portion embedded in the drill body, and a front end protruding from the drill body. The front end of the cemented carbide button is substantially semi-spherically curved and defined by a radius whose origin is disposed axially rearwardly of a plane through the largest diameter of the button. The button projects from the drill bit body a distance which is not less than 50% of the button diameter. A conical intermediate surface forms, in cross-section, an acute angle of about 13–19° with an envelope surface of the rear mounting portion.

9 Claims, 3 Drawing Sheets

PERCUSSION DRILL BIT AND A REGRINDABLE CEMENTED CARBIDE BUTTON THEREFOR

TECHNICAL BACKGROUND

The present invention relates to a percussion drill bit for drilling bores in rock. A typical percussion drill bit comprises a steel drill body, means at one end of the drill body for connecting the bit to a percussive unit such as a drill string for a jack hammer or a down-the-hole hammer, and a plurality of buttons embedded in the other end of the drill body. The present invention also relates to a regrind able button for use in said drill bit.

Each button comprises a cemented carbide body having a rear mounting portion embedded in the drill body and a front end protruding from the drill body.

Known drill bits that are provided with non-enhanced cemented carbide buttons such as disclosed in EP-B1-886 715 have disadvantages in that they wear prematurely and have slow penetration rates. Furthermore regrinding of conventional buttons becomes unstable. Other known drill bits are shown in U.S. Pat. No. 3,788,409 and U.S. Pat. No. 6,220,376.

OBJECTS OF THE INVENTION

An object of the present invention is to provide a drill bit for percussive drilling, wherein the life of the bit is extended.

Another object of the present invention is to provide a drill bit for percussive drilling with an increased penetration rate.

Still another object of the present invention is to provide a regrindable cemented carbide button for percussive drilling, which makes the pressing tool more durable.

Still another object of the present invention is to provide a regrindable cemented carbide button for percussive drilling, which button can be reground in a stable manner.

Still another object of the present invention is to provide a regrindable cemented carbide button for percussive drilling, which button can be reground in a stable manner.

DESCRIPTION OF THE DRAWINGS

The objects and advantages of the invention will become apparent from the following detailed description of a preferred embodiment thereof in connection with the accompanying drawing in which like numerals designate like elements, and in which.

DESCRIPTION OF A PREFERRED EMBODIMENT OF THE INVENTION

Figure 1A:
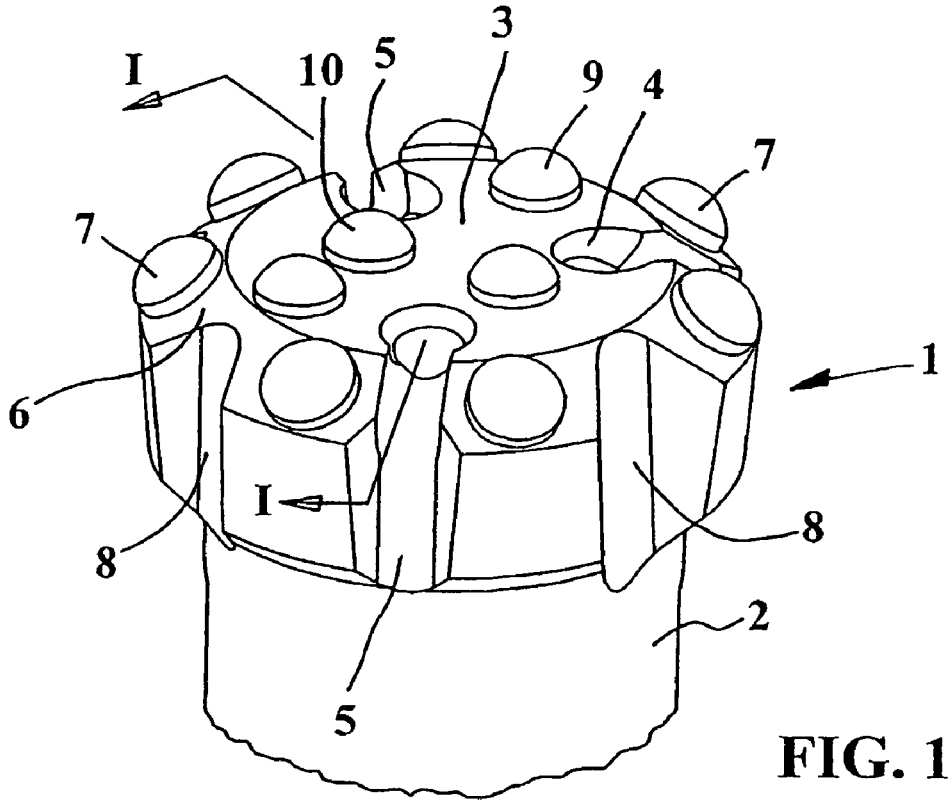
FIG. 1A shows a partial perspective view illustrating a drill bit according to the present invention.
Figure 1B:
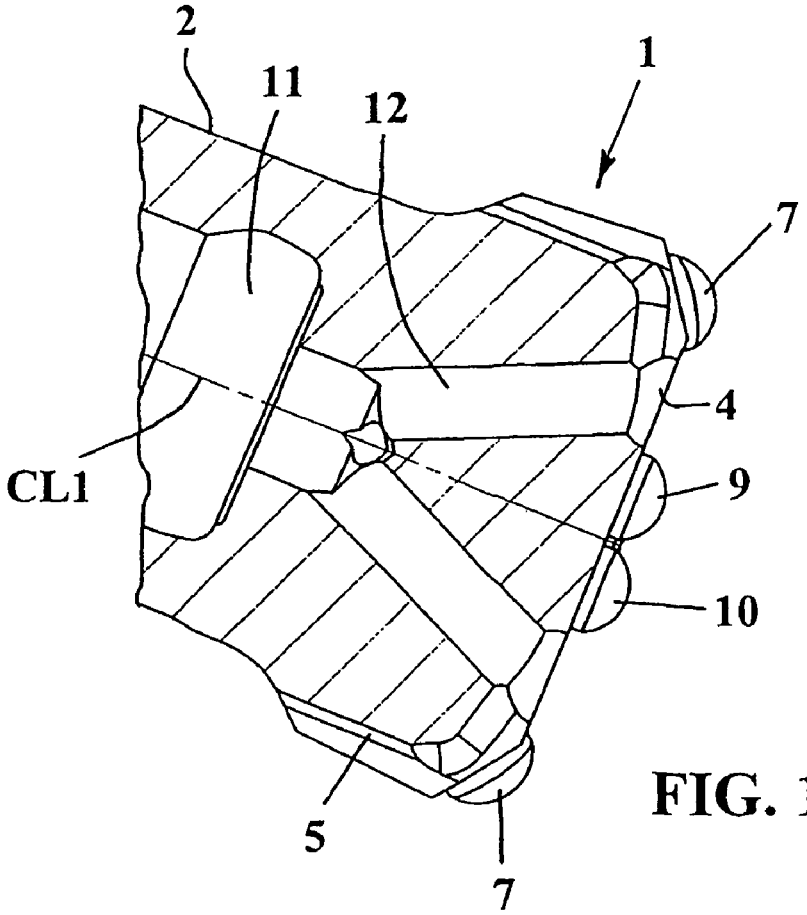
FIG. 1B shows a cross-sectional view of the drill bit in FIG. 1A according to the line I—I.

In FIGS. 1A and 1B a rock drill bit is shown, which in a usual manner comprises a body and cemented carbide buttons. The body comprises a substantially cylindrical head portion 1 and a more slender shaft 2. The body of the drill bit is made of steel. The head portion 1 comprises a front surface or a front side designated with 3, in which a number of buttons are mounted. The front surface may be substantially planar. A first surface portion 6, located between the front surface 3 and the periphery of the head portion, is conically shaped. On this conical surface 6 are provided a number of first buttons or gauge row buttons 7 forming a peripheral ring on the head portion. The buttons 7 in this case project somewhat outside the periphery of the head portion in order to machine a hole during drilling which has a somewhat bigger diameter than the very head portion. Chipways or recesses 8 are provided in areas between adjacent peripheral buttons 7, through which flush medium can pass. A number of front buttons are provided also in the area located inside the peripheral buttons 7, which depending on their position, are designated by numerals 9 and 10, respectively. The shaft 2 constitutes a connecting section which is to be coupled to a drill tube or a drill rod in a drill string by means of a threaded connection, not shown, or to a driver sub of a down-the-hole hammer, not shown, so as to transfer rotational movement in the usual manner. The tube or rod includes a channel for conveying a flush medium.

A main channel 11 for flush medium is provided inside the drill bit. This main channel communicates at its forward end with a number of branch channels 12, which terminate in recesses 4 in the front surface 3 and in return grooves 5. In this connection it may be noted that one or more flush medium channels also can terminate in the chipways 8. The flush medium will in practice be water or air.

Figure 2:
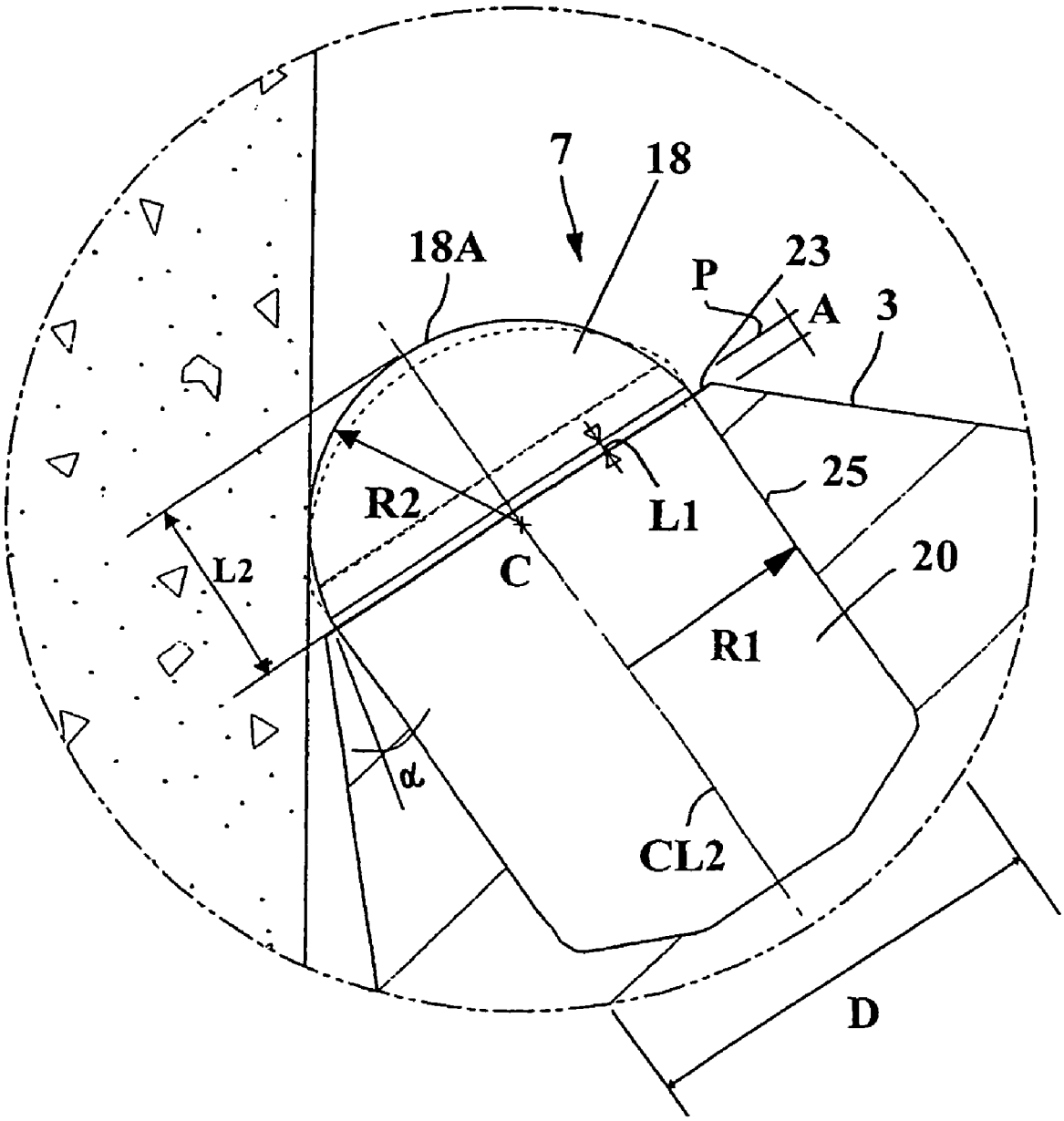
FIG. 2 shows a sectional view of a button according to the present invention, in relation to a drill bit body, and a prior art geometry shown in dashed lines.
Figure 4:
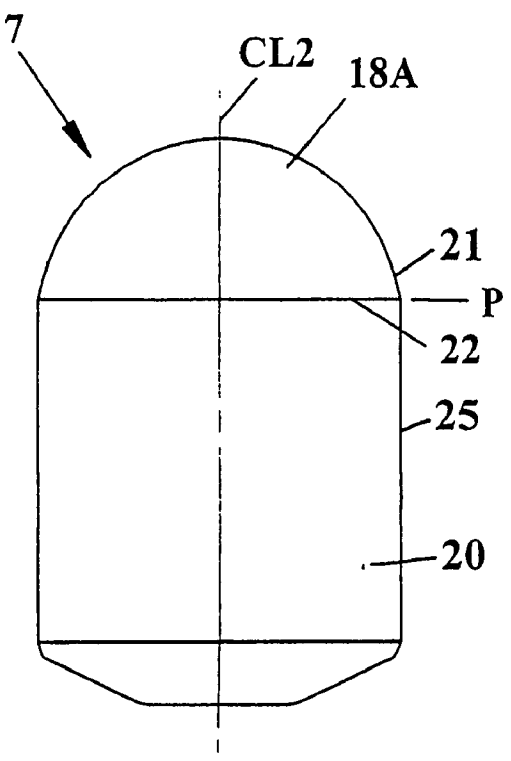
FIG. 4 shows a side elevational view of a button according to the present invention.
Figure 3:
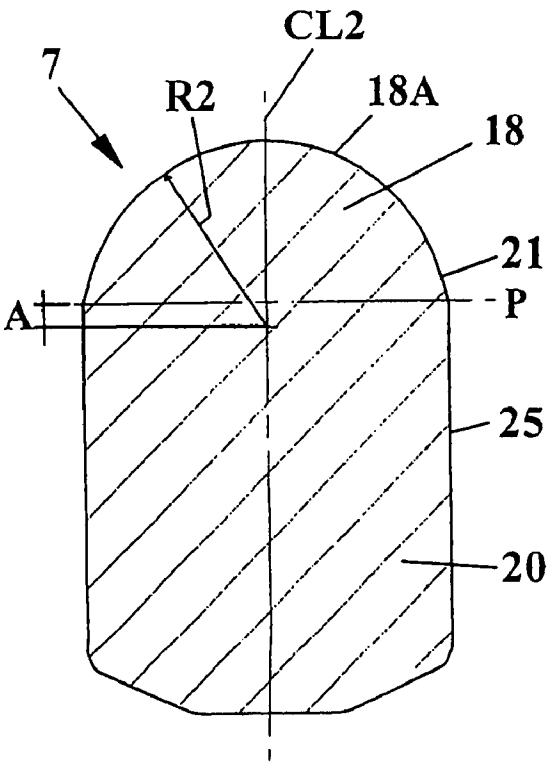
FIG. 3 shows a button according to the present invention in longitudinal section.
Figure 5:
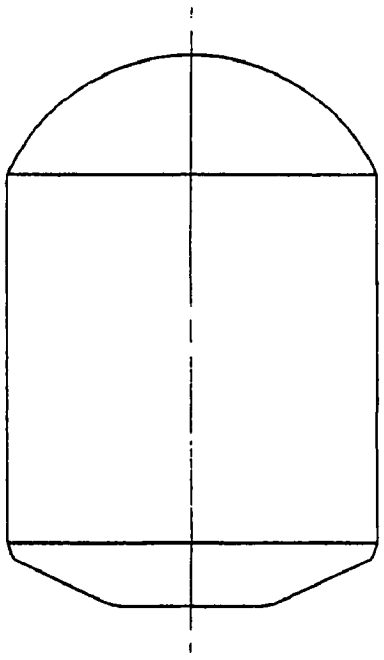
FIG. 5 shows a side elevational view of a prior art button.

A number of un-coated buttons 7, 9 and 10 is provided in the conical surface 6 and in the front surface 3 of the drill body. The buttons are completely made of cemented carbide and secured in borings preferably by press fit. A number of buttons 7 is positioned at the periphery of the bit 10, the radially outer portions of which define the diameter of the bit and thus the diameter of the bore being drilled. At least each row button 7 when mounted projects a maximum distance L2 from the associated rim surface 23 of the bit body 2 (FIG. 2). The distance L2 is large in comparison with the prior art button as shown as a dashed line in FIG. 2, i.e. about 53% of the button diameter D to compare with 49% for the prior art button. In other words in accordance with the present invention the distance L2 is not less than 50% of the button diameter D, preferably g not less than 52%.

The buttons 7 are tilted in such a way, that a longitudinal centerline (center axis) CL2 of each button 7 diverges by a preferably acute angle from the longitudinal center axis CL1 of the drill bit in a forward direction of the bit.

All buttons 7, 9 and 10 are embedded in the front surface of the drill body. Each button comprises a non-enhanced cemented carbide body having a cylindrical grip or mounting portion 20 embedded in the drill body and a front converging end protruding from the drill body. A radius R1 defines the envelope surface 25 of the mounting portion 20. The converging end of each cemented carbide button defines the cutting end 18 of the button. The surface 18A of the cutting end 18 starts from an edge 22 substantially lying in a plane P, see FIG. 2. The edge 22 is preferably disposed at a junction between a conical intermediate surface 21 of the surface 18A, and the cylindrical envelope surface 25. The conical intermediate surface 21 forms in the cross-section of FIG. 2 an acute angle $\alpha$ of about 13–19°, preferably about 15° with the envelope surface 25 of the rear mounting portion 20. The conical intermediate surface is there for pressing reasons when compacting the carbide and binder powder which makes the upper or lower punch in the pressing tool more durable. The edge 22 is parallel with the associated rim surface 23 and they are spaced by the distance L1, which is in the magnitude of 0.5 to 2 mm.

The longitudinal centerline CL1 of the drill bit and the longitudinal centerline CL2 of the buttons 7 include an angle therebetween. The angle is in the range of about 13°–163°, preferably 20°–55°.

The surface 18A of the cutting end 18 of the button includes a front portion 18B which extends from the conical portion 21 and is substantially semi-spherically curved and defined by a radius R2 lying on the center axis CL2, and the origin C of the radius R2 is positioned axially rearwardly of the plane P. The plane P intersects the center axis CL2 at a point. The distance A between said point and the radius origin C is 5 to 10% of the radius R1. The radius R2 is about 85% to 115% of the radius R1 of the rear mounting portion 20.

Since the radius R2 of the semi-spherical cemented carbide front end is smaller than hitherto known buttons the new inventive drill bit will drill longer than prior art drill bits before regrinding is needed, i.e. there is be more cemented carbide in the cutting end 18 of the inventive cemented carbide button (compare the dashed line in FIG. 2). Furthermore, the drill bit will achieve an increased penetration rate due to the higher contact pressure that each button exerts on the rock surface in the borehole. In addition, the inventive cemented carbide button can be reground in a stable manner since the button projects from the steel bit body more than usual and thus the grinding recess of a grinding cup will be made deeper than previous cups. The grinding cup will thus have a substantially semi-spherical recess adapted to grind the button, which recess has a depth which is not less than 50% of the largest diameter of the recess and preferably not less than 52%. The radius of the semi-spherical recess is about 85% to 115% of the radius R1 of the rear mounting portion 20. With the term "regrindable" is here meant that a single grinding cup rotating and orbiting on the button end can substantially restore the original shape of the button end.

Tests have shown that during percussive drilling the duration of life of the inventive bit was twice the life of conventional bits. The diameters of the buttons of said inventive bits were chosen such that the largest buttons 7 were located at the periphery and the inner buttons 9 were smaller while the innermost buttons 10 were smallest in diameter. The projections from the rim surfaces 23 varied in a similar way. i.e. from 9.4 mm to 8.6 mm and 7.6 mm, respectively.

Furthermore, the shape of the button according to the present invention gives a freedom for the drill bit designer in that the present button can be mounted in the drill bit at an inclination angle within an interval of about 150° starting from about 13° relative to the bit axis CL1.

The geometry of the button according to the present invention provides numerous advantages as compared with prior buttons such as extended life, increased penetration rate and stable regrinding.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

The invention claimed is:

1. A percussion drill bit for drilling a bore, comprising:

a rotary drill body including a rear connection section and a front head section; and a plurality of regrindable cemented carbide buttons carried by the drill body, each button defining a longitudinal center axis and comprising:

a rear mounting portion embedded in the front head section and defining a largest diameter, and a front cutting portion protruding from the drill body by a distance no less than 50% of the largest diameter of the rear mounting portion, the front cutting portion having an outer surface extending forwardly from a junction with an envelope surface of the mounting portion, the outer surface including:

a front surface portion of substantially semi-spherical shape having a radius whose origin lies on the longitudinal center axis at a location rearwardly of the junction, and a conical surface portion extending between the junction and the front surface portion and increasing in cross section as it approaches the junction, the conical portion forming an acute angle in the range of about 13–19 degrees with the envelope surface of the mounting portion.

2. The drill bit according to claim 1 wherein the distance that the front cutting portion protrudes from the drill body is no less than 52% of the largest diameter of the mounting portion.

3. The drill bit according to claim 2 wherein the largest diameter of the mounting portion is located at the junction.

4. The drill bit according to claim 1 wherein the radius of the mounting portion is in the range of about 85% to 115% of a largest radius of the rear mounting portion.

5. The drill bit according to claim 1 wherein the mounting portion is of cylindrical shape.

6. A regrindable cemented carbide button for use in a percussive rock drill bit, the button comprising:

a rear mounting portion, and a front cutting portion having an outer surface extending forwardly from a junction with an envelope surface of the mounting portion, the outer surface including:

a front surface portion of substantially semi-spherical shape having a radius whose origin lies on the longitudinal center axis at a location rearwardly of the junction, and a conical surface portion extending between the junction and the front surface portion and increasing in cross section as it approaches the junction, the conical portion forming an acute angle in the range of about 13–19 degrees with the envelope surface of the mounting portion.

7. The button according to claim 6 wherein a largest diameter of the mounting portion is located at the junction.

8. The button according to claim 6 wherein the radius of the mounting portion is in the range of about 85% to 115% of a largest radius of the mounting portion.

9. The button according to claim 6 wherein the mounting portion is of cylindrical shape.

* * * * *